US008185038B2

(12) United States Patent
Eda et al.

(10) Patent No.: US 8,185,038 B2
(45) Date of Patent: May 22, 2012

(54) CURL CORRECTION DEVICE AND IMAGE FORMING APPARATUS

(75) Inventors: Masakatsu Eda, Ebina (JP); Norio Ogawahara, Ebina (JP); Noriyuki Miyoshi, Ebina (JP); Nobuyoshi Komatsu, Ebina (JP); Tatsunori Izawa, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 456 days.

(21) Appl. No.: 12/393,543

(22) Filed: Feb. 26, 2009

(65) Prior Publication Data

US 2009/0257802 A1 Oct. 15, 2009

(30) Foreign Application Priority Data

Apr. 10, 2008 (JP) ..... 2008-102772

(51) Int. Cl.
*G03G 15/00* (2006.01)
*B65H 31/00* (2006.01)

(52) U.S. Cl. ..... 399/406; 271/209

(58) Field of Classification Search ..... 399/406, 399/122; 271/161, 188, 209
See application file for complete search history.

(56) References Cited

U.S. PATENT DOCUMENTS 5,956,554 A * 9/1999 Yanashima et al. ..... 399/328
6,259,888 B1 * 7/2001 Kazama et al. ..... 399/406

FOREIGN PATENT DOCUMENTS

JP 2003-012215 1/2003

* cited by examiner

*Primary Examiner* — Judy Nguyen
*Assistant Examiner* — Justin Olamit
(74) *Attorney, Agent, or Firm* — Morgan, Lewis & Bockius LLP

(57) ABSTRACT

A curl correction device that corrects curl, including: a curl correction shaft that drives to carry a sheet; a first supporting member that supports the curl correction shaft; a curl correction roll that holds the sheet between the curl correction shaft and the curl correction roll and presses the sheet against the curl correction shaft; a second supporting member that supports the curl correction roll and rotates the curl correction roll around a first end in the longitudinal direction of the curl correction roll between closed state and open state; and a cam mechanism that provides, via a cam, the curl correction shaft with driving force for pressing the curl correction roll according to a position of the cam, the cam mechanism being provided with a cam shaft, a connecting member, a first cam receiving member, and a second cam receiving member.

8 Claims, 13 Drawing Sheets

RELATED ART

RELATED ART

CURL CORRECTION DEVICE AND IMAGE FORMING APPARATUS

CROSS-REFERENCE TO RELATED APPLICATIONS

This application is based on and claims priority under 35 USC 119 from Japanese Patent Application No. 2008-102772 filed on Apr. 10, 2008.

BACKGROUND (i) Technical Field

The present invention relates to a curl correction device that corrects curl of a sheet and an image forming apparatus that is equipped with a housing for the curl correction device.

(ii) Related Art

In an image forming apparatus used for an electro-photographic copier and a printer, a photoreceptor is charged and exposed to a light, thereby forming an electrostatic latent image on the surface thereof. The electrostatic latent image is developed with a toner, thereby generating a toner image which is then transferred onto a sheet directly or indirectly, for example, via an intermediate transfer member. Subsequently, the sheet to which the toner image is transferred is heated and pressed to fix the toner image to the sheet, thereby forming an image on the sheet. Here, as a fixing device for fixing the transferred toner image to a sheet, there has been widely known a fixing device that has a rotating heating roll equipped with a heater and a pressure roll or a pressure belt that is disposed adjacent to the heating roll with a sheet interposed therebetween and that pressurizes the heating roll. Sheets output from a fixing device such as those described above sometimes have curls (curl of paper), which are difficult to be stacked appropriately on an exit tray, thereby causing paper jam when post-processing by a sorter or the like is required.

SUMMARY

According to an aspect of the invention, there is provided a curl correction device that corrects curl, which includes: a curl correction shaft that drives to carry a sheet;

a first supporting member that supports the curl correction shaft;

a curl correction roll that operates in closed state where the curl correction is disposed in parallel with the curl correction shaft, holds the sheet between the curl correction shaft and the curl correction roll and presses the sheet against the curl correction shaft;

a second supporting member that supports the curl correction roll, and rotates the curl correction roll around the vicinity of a first end in the longitudinal direction of the curl correction roll between the closed state and open state in which a second end in the longitudinal direction of the curl correction roll is placed away from the curl correction shaft; and a cam mechanism that provides, via a cam, the curl correction shaft with driving force for pressing the curl correction roll according to a position of the cam, wherein the cam mechanism includes:

a cam shaft that is supported by the first supporting member, extended in parallel with the curl correction shaft, and rotated in response to driving force, the cam shaft having a first rotation cam and a second rotation cam fixed thereto at positions respectively corresponding to the first end and the second end of the curl correction roll;

a connecting member that is pivotally supported by the first supporting member at a position corresponding to the first end of the curl correction roll, and that receives, from the first rotation cam, driving force corresponding to rotation angle of the cam shaft;

a first cam receiving member that is fixed to the first end of the curl correction roll, and that receives, from the first rotation cam, driving force according to rotation angle of the cam shaft via the connecting member; and a second cam receiving member that is fixed to the second end of the curl correction roll extending toward the second rotation cam, and receives from the second rotation cam driving force according to rotation angle of the cam shaft.

BRIEF DESCRIPTION OF THE DRAWINGS

Exemplary embodiments of the present invention will be described in detail based on the following figures, wherein.

DETAILED DESCRIPTION

Figure 1:
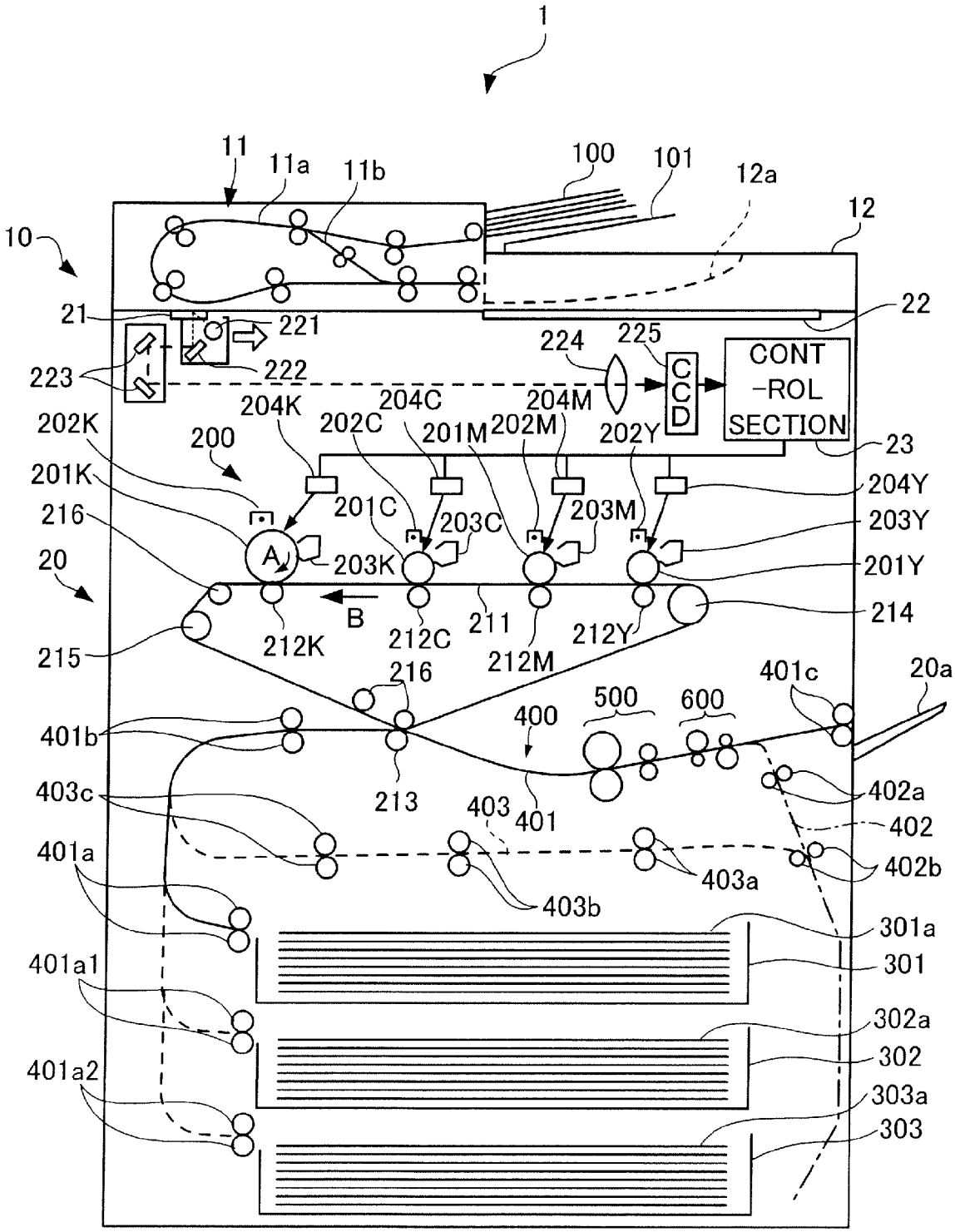
FIG. 1 is a schematic diagram that is one exemplary embodiment of an image forming apparatus according to the present invention.

FIG. 1 is a schematic diagram that is one exemplary embodiment of an image forming apparatus according to the present invention.

FIG. 1 shows a copier 1 that is the present exemplary embodiment and equipped with one exemplary embodiment of a curl correction device according to the present invention. The copier 1 has an original carrying unit 10 provided with a sheet paper carrying section 101 on which one or more sheets are placed and a housing 20 disposed under the original carrying unit 10. The housing 20 has an exit tray 20*a* to which sheets having images recorded thereon are output.

The original carrying unit 10 has an automatic carrying section 11 that carries originals 100 placed on the sheet paper carrying section 101 one by one along a carrier path 11*a* and a housing 12. In the original carrying unit 10, originals 100 carried along the carrier path 11*a* are output to an upper surface 12*a* of the housing 20. In addition, the automatic carrying section 11, when a user instructs to read images of both the front and back of the original 100, carries the original 100 carried along the carrier path 11*a* to a reverse carrier path 11*b* to reverse the original 100 and carries the reversed original 100 again to the carrier path 11*a*.

The housing 20 has a contact glass 21 that is disposed in a position to face the original 100 carried by the original carrying unit 10, and a platen glass 22 disposed adjacent to the contact glass 21 and on which a user places originals one by one. In addition, the housing 20 has a light source 221 disposed in a manner to extend from the front side to the back side in FIG. 1 and that emits irradiation light to the original 100, and a reflection mirror 222 that directs light reflected on the original 100 in the horizontal direction, a pair of reflecting mirrors 223 that make the light reflected on the original 100 and directed in the horizontal direction to head in the opposite direction, a lens 224 that forms an image of the light reflected from the mirrors 223, a CCD (Charge Coupled Device) 225 or an image receiving sensor that receives a light image formed by the lens 224 and outputs image data, and a control section 23 that controls the housing 20 as a whole as well as inputs analog image data and performs image processing.

Further, the housing 20 has an image forming section 200 that forms a toner image in accordance with image signals and transfers the toner image onto a sheet carried thereto. The image forming section 200 has charging sections 202Y, 202M, 202C, 202K that supply charge respectively to photoreceptors 201Y, 201M, 201C, 201K rotating in the direction of arrow A; developers 203Y, 203M, 203C, 203K having respective toners Y, M, C, K therein; and exposure sections 204Y, 204M, 204C, 204K that emit exposure light based on image data from the control section 23. In addition, the image forming section 200 has an intermediate transfer belt 211 rotating in the direction of arrow B, primary transfer rolls 212Y, 212M, 212C, 212K that are opposed to the photoreceptors 201Y, 201M, 201C, 201K with the intermediate transfer belt 211 interposed therebetween. Note that the copier 1 can copy in a full color and Y, M, C and K respectively represent elements of yellow, magenta, cyan, and black image formation.

Further, the image forming section 200 has a secondary transfer belt 213 that secondarily transfers the toner image that is primarily transferred to the intermediate transfer belt 211, a driving roll 214 that drives the intermediate transfer belt 211, a tension roll 215 for stretching the intermediate transfer belt 211, and idle rolls 216.

In the image forming section 200, the surfaces of photoreceptors 201Y, 201M, 201C, 201K charged by the charging sections 202Y, 202M, 202C, 202K are irradiated with exposure light generated respectively by the exposure sections 204Y, 204M, 204C, 204K, thereby creating electrostatic latent images thereon. The electrostatic latent images are developed with toner provided in the developers 203Y, 203M, 203C, 203K. The developed images are primarily transferred onto the intermediate belt 211 by the primary transfer rolls 212Y, 212M, 212C, 212K, which creates toner images in color. The color toner images are transferred to a sheet carried in a manner described later by the secondary transfer belt 213.

The housing 20 is capable of accommodating three sheet cassettes 301, 302, 303 that respectively stock three different sizes of sheets 301*a*, 302*a*, 303*a*. Thus, a desired size of sheet can be specified to form image on the sheet.

Further, the housing 20 has a sheet carrying section 400 for carrying a sheet, a fixing section 500, and a curl correction device 600. The curl correction device 600 that will be described later in detail is an integral assembly that can be pulled out from the housing 20.

The sheet carrying section 400 has a first sheet-carrying path 401, a second-sheet carrying path 402, and a third-carrying path 403.

The first sheet-carrying path 401 is used for carrying a sheet with an instruction for recording an image on a single side of a sheet, and has carrying rolls 401*a* (or 401*a*1, 401*a*2), 401*b*, and an exit roll 401*c*.

The second sheet-carrying path 402 is used for recording an image on the back of the sheet by guiding the sheet thereto not to the exit tray 20*a*, with an instruction for recording images on both sides of a sheet. The second sheet-carrying path 402 has carrying rolls 402*a*, 402*b*.

The third sheet-carrying path 403 is used for carrying the sheet guided by the second sheet-carrying path 402, for reversing and guiding the sheet back to the first sheet-carrying path 401, thereby recording an image on the back side of the sheet. The third sheet-carrying path 403 has carrying rolls 403*a*, 403*b*, and 403*c*.

Hereafter, descriptions will be made on the fixing section 500 and the curl correction device 600 referring to FIG. 2.

Figure 2:
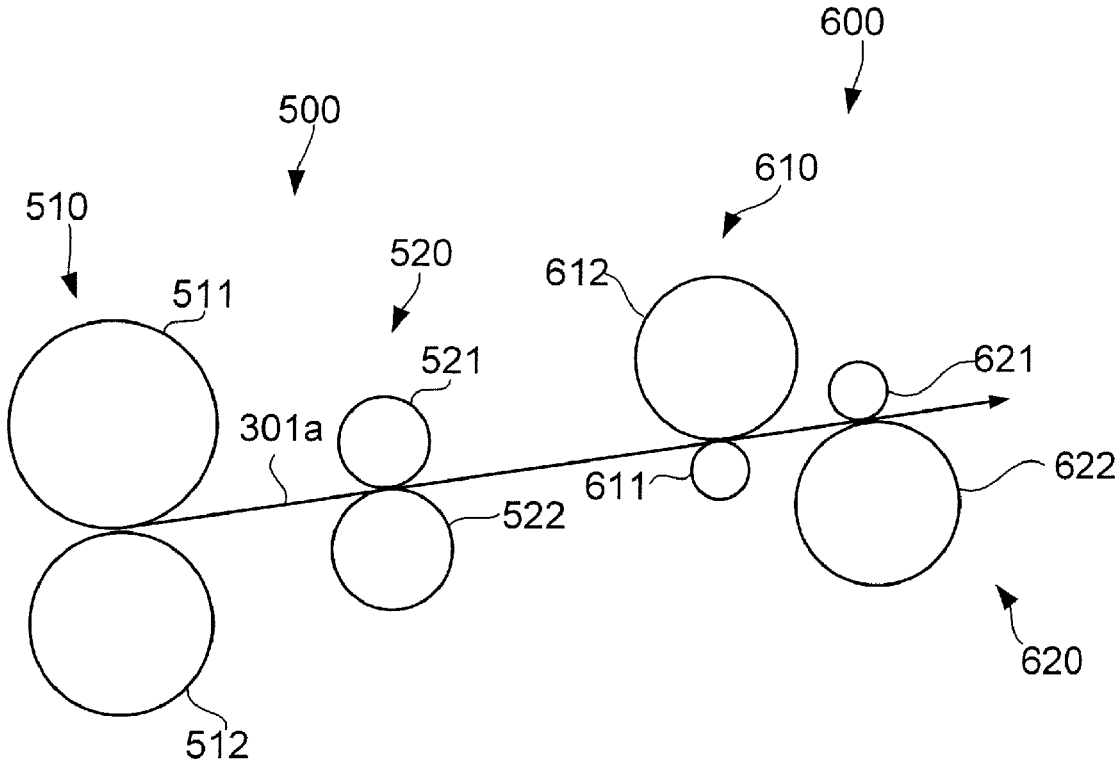
FIG. 2 is an enlarged view of a fixing section and a curl correction device shown in FIG. 1.

FIG. 2 is an enlarged view of the fixing section 500 and the curl correction device 600 shown in FIG. 1.

The fixing section 500 shown in FIG. 2 has a fixing unit 510 provided with a heating roll 511 and a pressure roll 512 (or pressure belt), and an exit roll unit 520 provided with exit rolls 521, 522. Here, it is assumed that a sheet 301*a* to which a color toner image is transferred by the secondary transfer belt 213 as described above is carried from the left in FIG. 2. The fixing unit 510 heats the sheet 301*a* by the heating roll 511 and pressurizes the sheet by the pressure roll 512, thereby fixing the toner image onto the sheet 301*a*. The sheet to which the toner image is fixed is output by the exit rolls 521, 522, and then carried to the curl correction device 600.

The curl correction device 600 corrects curl of the sheet 301*a* to which the toner image is fixed. The curl correction device 600 has an upper curl correction section 610 for correcting upper curl of the sheet 301*a* (i.e., curl bowed upward) and a lower curl correction section 620 for correcting lower curl (i.e., curl bowed downward).

The upper curl correction section 610 has a metal curl correction shaft 611 and an elastic curl correction roll 612.

The curl correction shaft 611 drives to carry the sheet 301*a* carried thereto.

The curl correction roll 612 is disposed in parallel with the curl correction shaft 611, and presses the sheet 301*a* interposed between the curl correction shaft 611 and the curl correction roll 612 against the curl correction shaft 611. Note that the elastic curl correction roll 612 has a diameter wider than that of the curl correction shaft 611, and its nip part that nips the sheet 301*a* in cooperation with the curl correction shaft 611 bows along the shape of the curl correction shaft 611.

In addition, the down curl correction section 620 has a metal curl correction shaft 621 and an elastic curl correction roll 622. The curl correction shaft 621 and the curl correction roll 622 are disposed and functions similarly to the curl correction shaft 611 and the curl correction roll 612.

Figure 3:
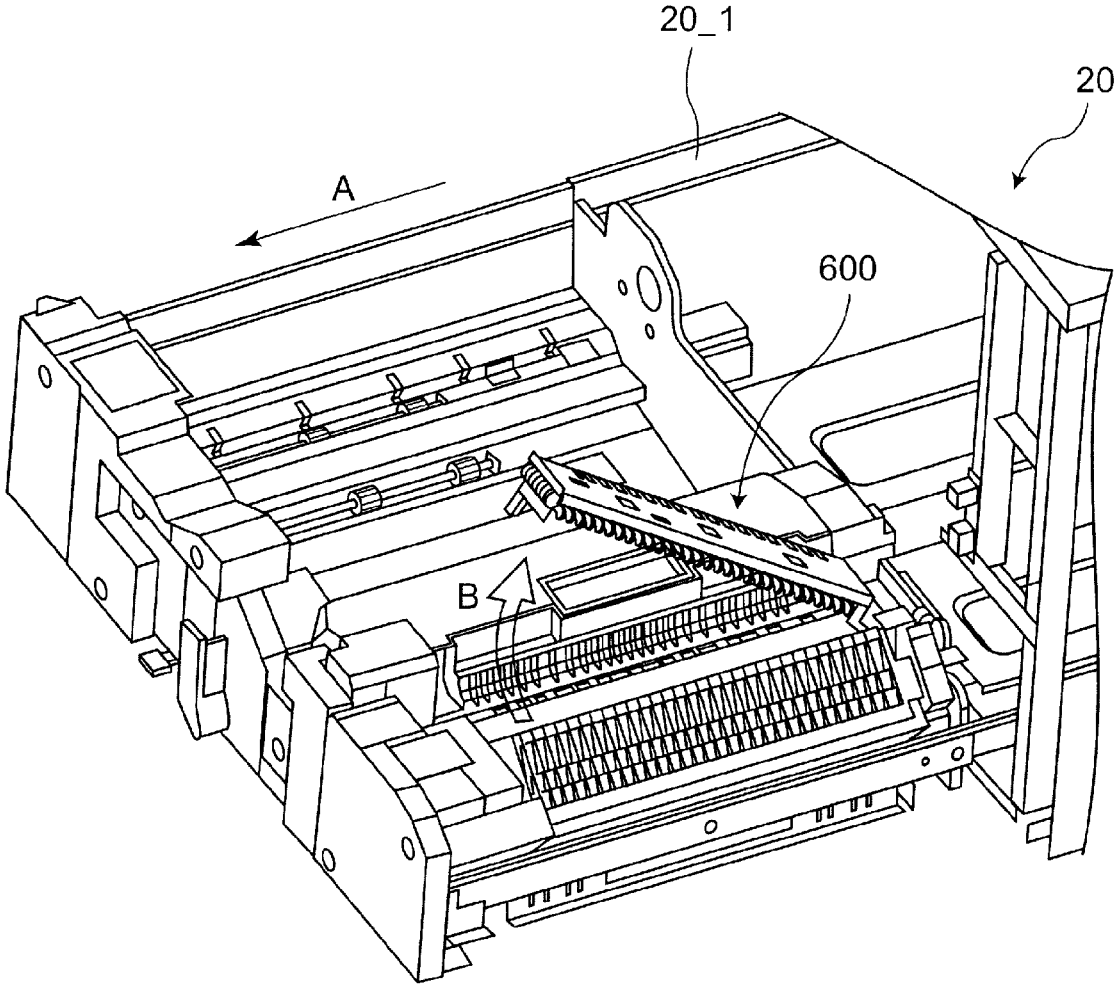
FIG. 3 is a diagram showing a state in which the curl correction device is pulled out of the image forming apparatus in order to be open.

FIG. 3 is a diagram showing a state in which the curl correction device 600 is pulled out of the image forming apparatus in order to be open.

The housing 20 shown in FIG. 3 includes a guiding member 20_1 for pulling the curl correction device 600 out from the housing 20 so that the curl correction device 600 can be accommodated in the housing 20. Usually, the curl correction device 600 is housed in the housing 20 via the guiding member 20_1. Note that a sheet is carried from the back to the front in FIG. 3. Incidentally, there are times when paper jam occurs in the curl correction device 600 during image forming process. In order to clear paper jam, the curl correction device 600 is pulled out and its upper assembly part, which will be described later, is lifted in the direction of arrow B. Hereafter, a structure of the curl correction device 600 will be described in detail, referring to FIG. 4.

Figure 4:
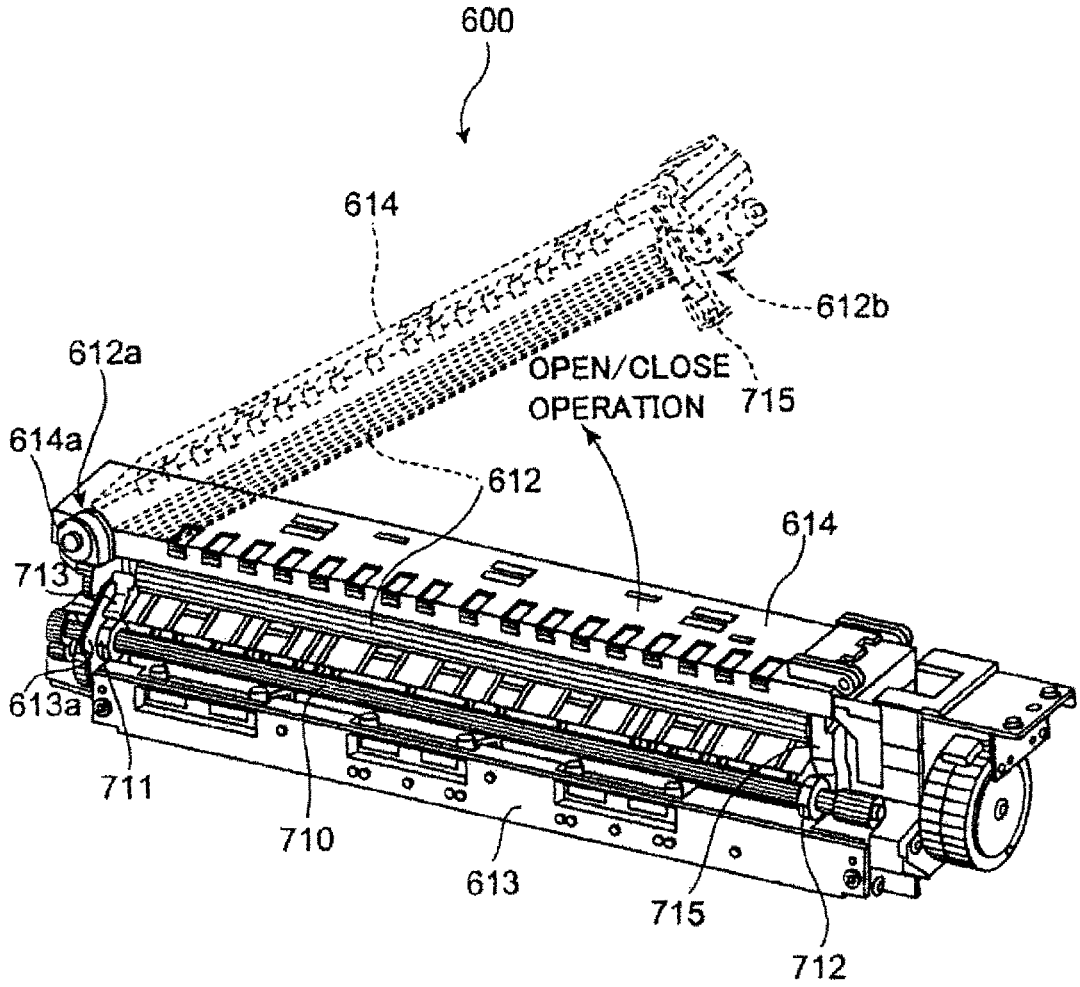
FIG. 4 is a perspective view of the curl correction device shown in FIG. 3.

FIG. 4 is a perspective view of the curl correction device 600 shown in FIG. 3.

The curl correction device 600 shown in FIG. 4 includes the curl correction roll 612 and the curl correction shaft 611 (not shown) disposed under the curl correction roll 612 that are elements of the above-described upper curl correction section 610, a cam shaft 710, a first rotating cam 711 and a second rotating cam 712, and a connecting member 713. It should be noted that the down curl correction section 620 (not shown) is disposed in the rear side under the curl correction roll 612 and the cam shaft 710.

The curl correction roll 612 is operated in the state when it is placed in parallel with the curl correction shaft 611 as indicated by solid lines in FIG. 4. As described referring to FIG. 2, the curl correction roll 612 holds a sheet carried from the front in FIG. 4 so as to be sandwiched between the curl correction roll 612 and the curl correction shaft 611 and presses it against the curl correction shaft 611.

The curl correction device 600 includes a lower assembly part 613 provided with a first supporting member 613*a* that supports the curl correction shaft 611. In addition, the curl correction device 600 includes an upper assembly part 614 provided with a second supporting member 614*a* that supports the curl correction roll 612. The second supporting member 614*a* rotates the curl correction roll 612 around the vicinity of a first end 612*a* in the longitudinal direction of the curl correction roll 612 between a closed state (indicated by solid lines) and an open state (indicated by dotted lines) where a second end 612*b* in the longitudinal direction of the curl correction roll 612 is placed away from the curl correction shaft 611. The curl correction device 600 is housed in the housing 20 in a manner as shown in FIG. 3 to be pulled out from the housing 20 with the second end 612*b* as a top.

Figure 5:
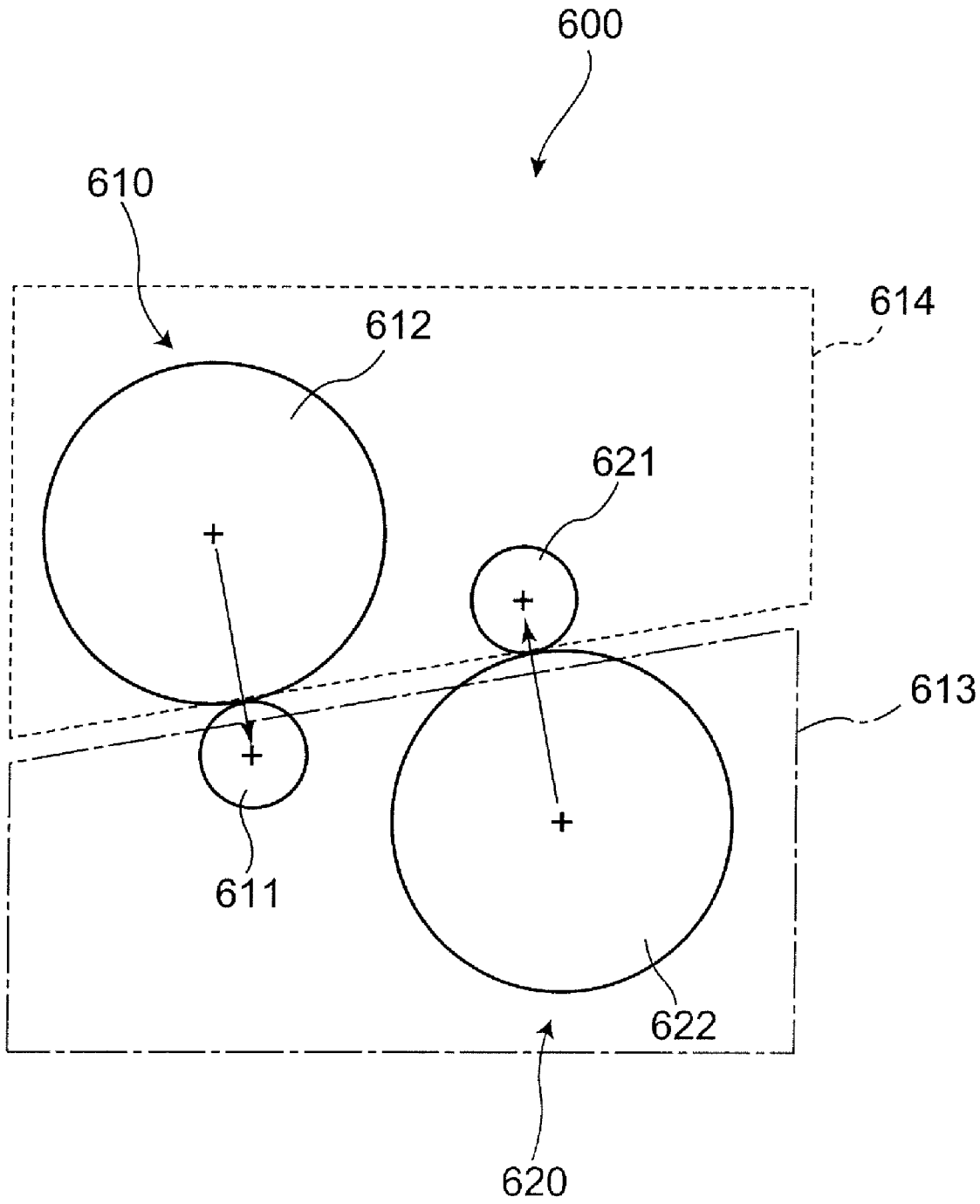
FIG. 5 is a schematic drawing showing an upper curl correction section and a down curl correction section of the curl correction device shown in FIG. 4 as viewed in the longitudinal direction.

FIG. 5 is a schematic drawing of the upper curl correction section 610 and down curl correction section 620 of the curl correction device 600 shown in FIG. 4 as viewed in the longitudinal direction.

The curl correction shaft 611 that is an element of the upper curl correction section 610 and the curl correction roll 622 that is an element of the down curl correction section 620 are provided in the lower assembly part 613. In addition, the curl correction roll 612 that is an element of the upper curl correction section 610 and the down curl correction shaft 621 that is an element of the down curl correction section 620 are provided in the upper assembly part 614. In the curl correction device 600, the curl correction shafts 611, 612 are caused to be pressed against the curl correction rolls 612, 622 respectively, using a cam mechanism 700 that will he described below.

Figure 6:
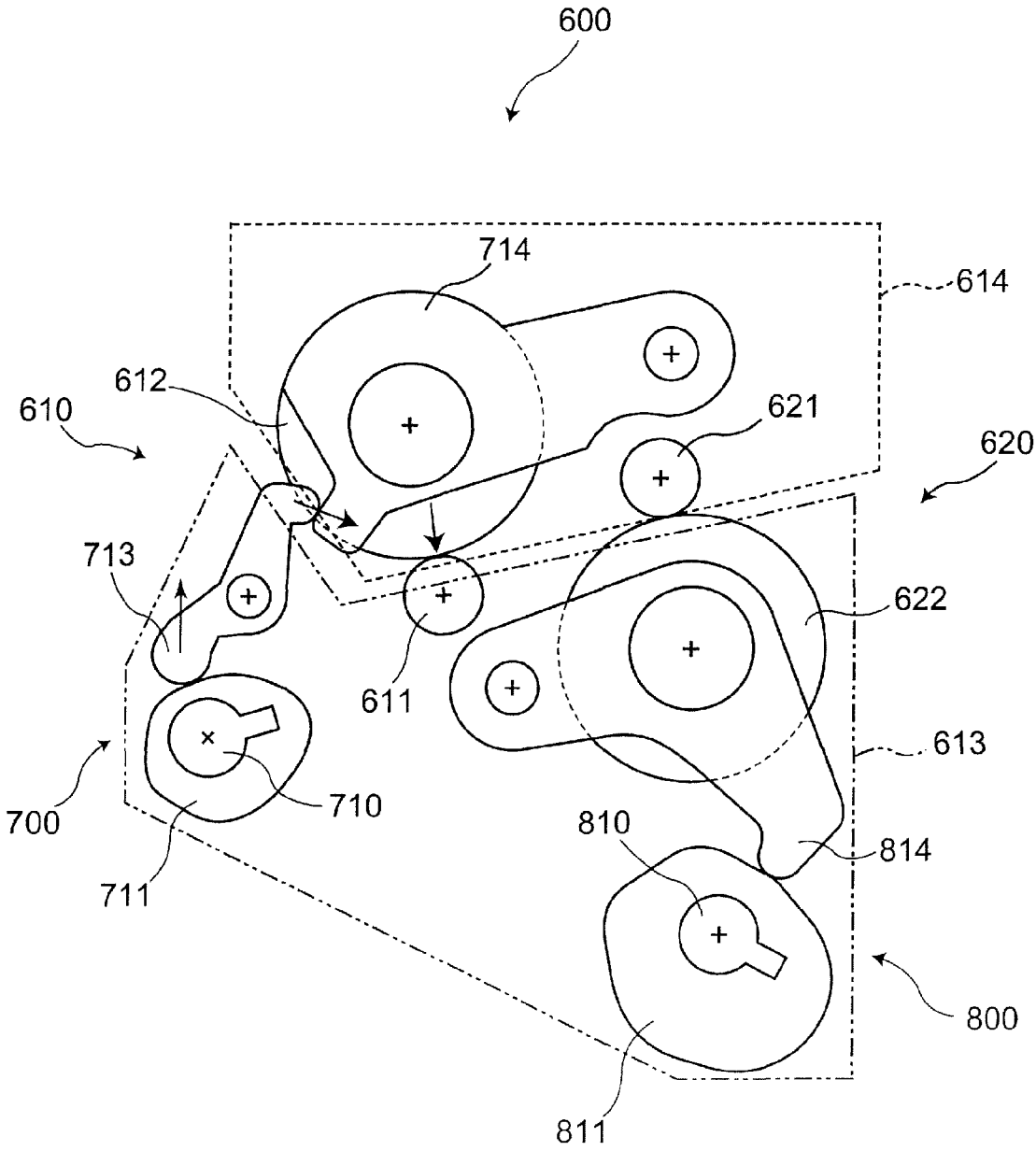
FIG. 6 is a schematic drawing showing a cam mechanism as well as the upper curl correction section and the down curl correction section of the curl correction device shown in FIG. 4 as viewed in the longitudinal direction.

Referring to FIGS. 4 and 6, the cam mechanism 700 will be described.

FIG. 6 is a schematic drawing of the cam mechanism 700 as well as the upper curl correction section 610 and the down curl correction section 620 of the curl correction device 600 shown in FIG. 4 as viewed in the longitudinal direction.

The curl correction device 600 shown in FIG. 6 is in a closed state and provided with the cam mechanism 700. The cam mechanism 700 includes a cam shaft 710 that is supported by the lower assembly part 613, extended in parallel with the curl correction shaft 611 and rotated driven by driving force. The cam shaft 710 includes a first rotation cam 711 and a second rotation cam 712 (only shown in FIG. 4) disposed at positions respectively corresponding to the first end 612*a* and the second end 612*b* of the curl correction roll 612 shown in FIG. 4.

Further, the cam mechanism 700 has the connecting member 713 that is pivotally supported by the lower assembly part 613 at a position corresponding to the first end 612*a* of the curl correction roll 612, and receives driving force according to the rotation angle of the cam shaft 710 from the first rotation cam 711.

In addition, the cam mechanism 700 has a first cam receiving member 714 that is fixed to the first end 612*a* of the curl correction roll 612 and receives driving force corresponding to the rotation angle of the cam shaft 710 from the second rotation cam 712 via the connecting member 713.

Further, the cam mechanism 700 has a second cam receiving member 715 that is fixed to the second end 612*b* of the curl correction roll 612, extending toward the second rotation cam 712, and receives driving force corresponding to the rotation angle of the cam shaft 710 from the second rotation cam 712.

The curl correction device 600 has a cam mechanism 800 that is disposed in the lower assembly part 613 shown in FIG. 6. The cam mechanism 800 has a cam shaft 810 that is extended in parallel with the curl correction shaft 621 and rotated by driving force. The cam shaft 810 has a rotation cam 811. The cam mechanism 800 further includes a cam receiving member 814 that receives driving force according to rotation angle of the cam shaft 810 from the rotation cam 811.

Hereafter, operation of the curl correction device 600 will be described referring to FIG. 6. A sheet to which a toner image is transferred is carried to the curl correction device 600. It should be noted here that the amount of upper curl and down curl of the sheet is predicted according to conditions of sheets such as material, weight, and size. A motor (not shown) rotates in a manner to correct the predicted amount of the upper curl and causes the cam shaft 710 to rotate from the normal position to a predetermined rotation angle. This displaces the first rotation cam 711 to a predetermined position. Then, the connecting member 713 receives driving force according to the rotation angle of the cam shaft 710 from the first rotation cam 711 and transmits the driving force to the first cam receiving member 714. In this way, the first cam receiving member 714 receives the driving force according to the rotation angle of the cam shaft 710 via the connecting member 713. Then, the curl correction roll 612 is made to contact the curl correction shaft 611 by predetermined nip amount (penetration amount) according to the driving force. At the same time, the curl correction shaft 611 rotates, driving the curl correction roll 612, which corrects upper curl of the sheet.

Further, in order to correct predetermined down curl, a motor (not shown) rotates to cause the cam shaft 810 to rotate a predetermined rotation angle, which displaces the second rotation cam 811 to a predetermined position. The second cam receiving member 814 receives driving force according to the rotation angle of the cam shaft 810 via the second rotation cam 811. Then, the curl correction roll 622 is made to contact the curl correction shaft 621 by a predetermined nip amount (penetration amount) according to the driving force. At the same time, the curl correction shaft 621 rotates, driving the curl correction roll 622, and thereby correcting down curl of the sheet.

Figure 7:
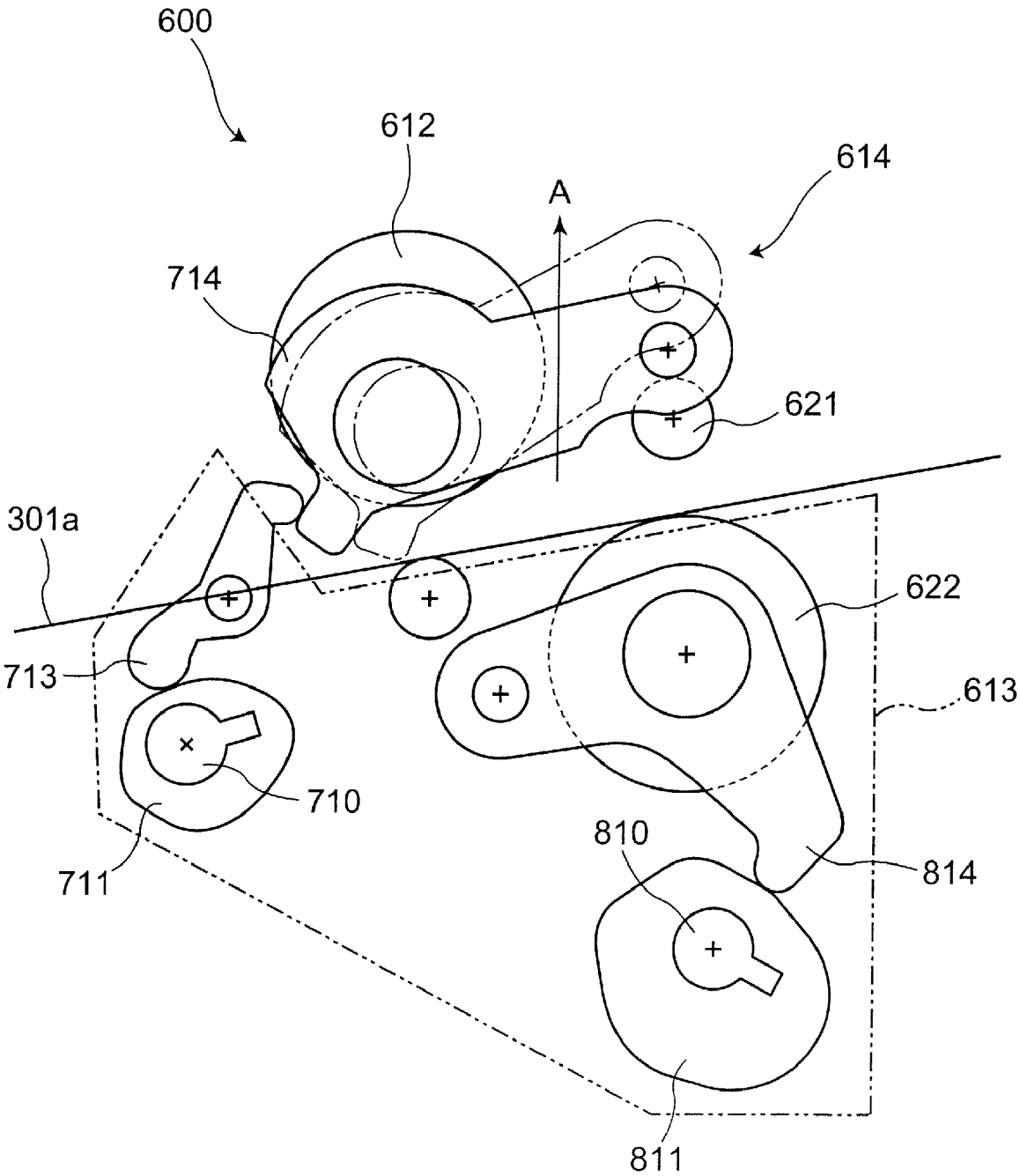
FIG. 7 is a drawing of the curl correction device of FIG. 6 being changed from a closed state to an open state.

FIG. 7 is a drawing of the curl correction device 600 shown in FIG. 6 that is being changed from a closed state to an open state.

There are times when paper jam occurs in the curl correction device 600 during image forming process. In order to clear a sheet 301 stuck in the curl correction device 600, the curl correction device 600 has a structure in which the first cam receiving member 714 is disposed at a position upper than that of the sheet 301*a* even when the upper assembly part 614 is lifted upward in the direction of arrow A in FIG. 7.

Figure 8:
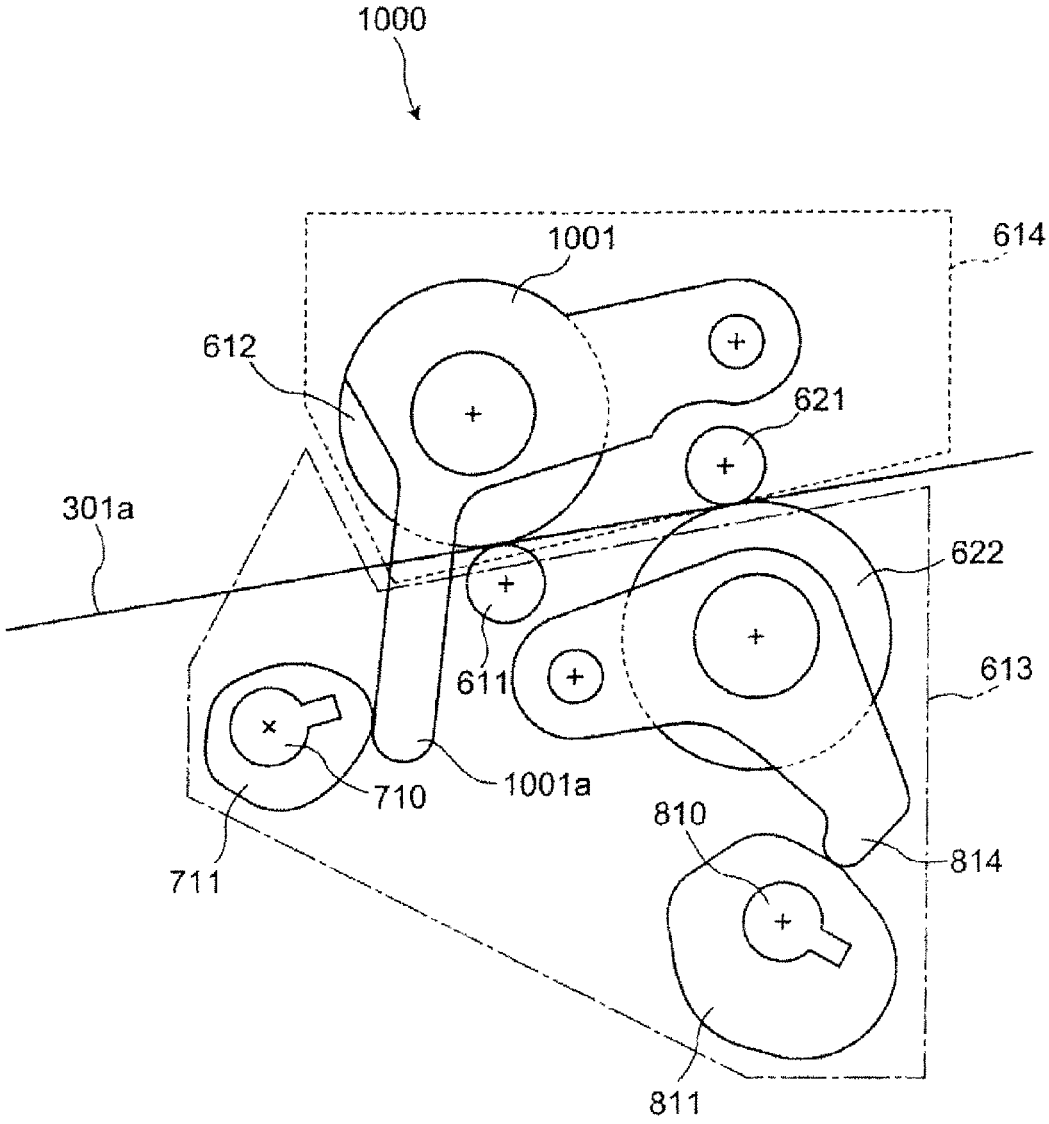
FIG. 8 is a schematic drawing of a conventional curl correction device as a comparative example.

FIG. 8 is a schematic drawing of a conventional curl correction device as a comparative example.

A curl correction device 1000 is different from the curl correction device 600 shown in FIGS. 6 and 7 in that the curl correction device 1000 are not provided with the connecting member 713, and has a first cam receiving section 1001 instead of the first receiving member 714 provided in the curl correction device 600. The first cam receiving section 1001 has a long lever 1001*a* that receives driving force from the first rotation cam 711.

In this curl correction device 1000, it is the lever 1001*a* of the first cam receiving section 1001 disposed in the upper assembly part 614 that receives driving force from the first rotation cam 711 disposed in the lower assembly part 613 in order to provide the curl correction roll 612 with predetermined penetration amount.

Figure 9:
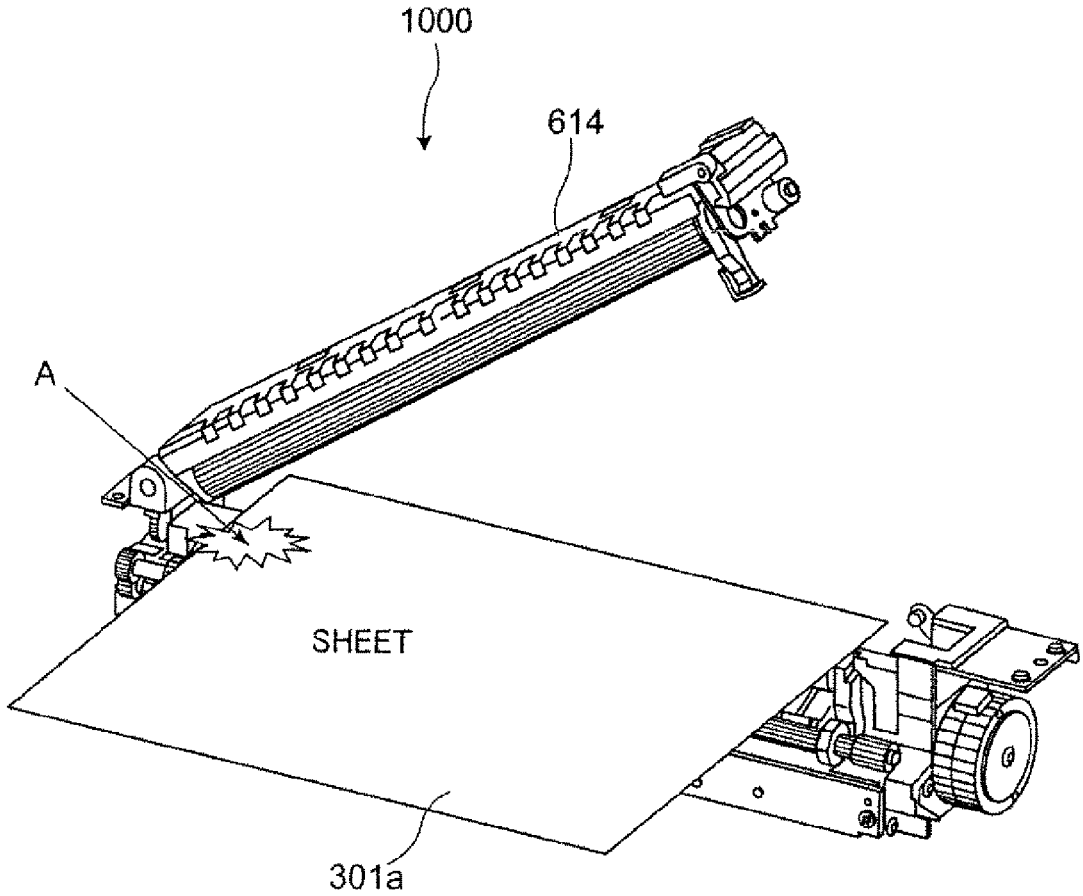
FIG. 9 is a drawing illustrating a state in which the curl correction device shown in FIG. 8 interferes with a sheet when the upper assembly part of the curl correction device is lifted upward.

FIG. 9 illustrates a state in which the curl correction device 1000 shown in FIG. 8 interferes with a sheet when the upper assembly part 614 of the curl correction device 1000 is lifted upward. It should be noted that the lever 1001*a* shown in FIG. 8 is omitted in FIG. 9 in order to avoid complications.

In the curl correction device 1000, when the upper assembly part 614 is lifted to remove the sheet 310 jammed in the curl correction device 1000, the long lever 1001*a* provided in the first cam receiving section 1001 interferes with the sheet 301*a* at an area A in FIG. 9.

Next, descriptions will be made on a case in which the curl correction device 600 is to be housed in the housing 20.

Figure 10:
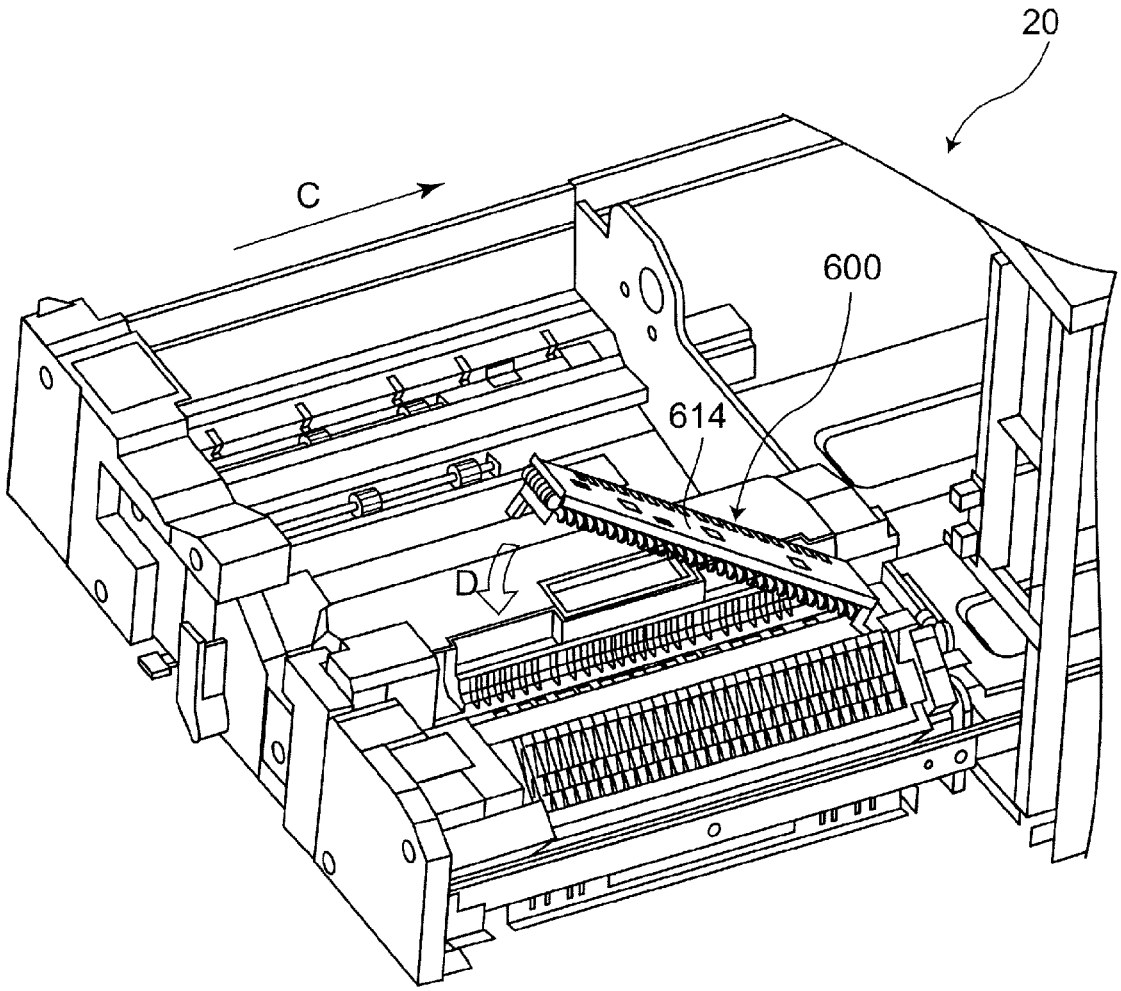
FIG. 10 is a drawing illustrating a state in which the curl correction device according to the present invention is being accommodated in a housing.

FIG. 10 illustrates a state in which the curl correction device according to the present invention is being accommodated in a housing.

The upper assembly part 614 of the curl correction device 600 shown in FIG. 10 is lifted around the end thereof closer to the housing 20. If the curl correction device 600 is to be housed in the housing 20 by being moved in the direction of arrow C while the upper assembly part is kept lifted by mistake, with the other end closer to the opening being held with a hand, the end closer to the housing 20 of the upper assembly part 614 touches the housing 20 and falls in the direction of arrow D. This may cause a finger to be caught and injured.

Hereafter, descriptions will be made on a curl correction device 600_1 that is provided with a finger-nip prevention member in addition to the elements of the curl correction device 600.

Figure 11:
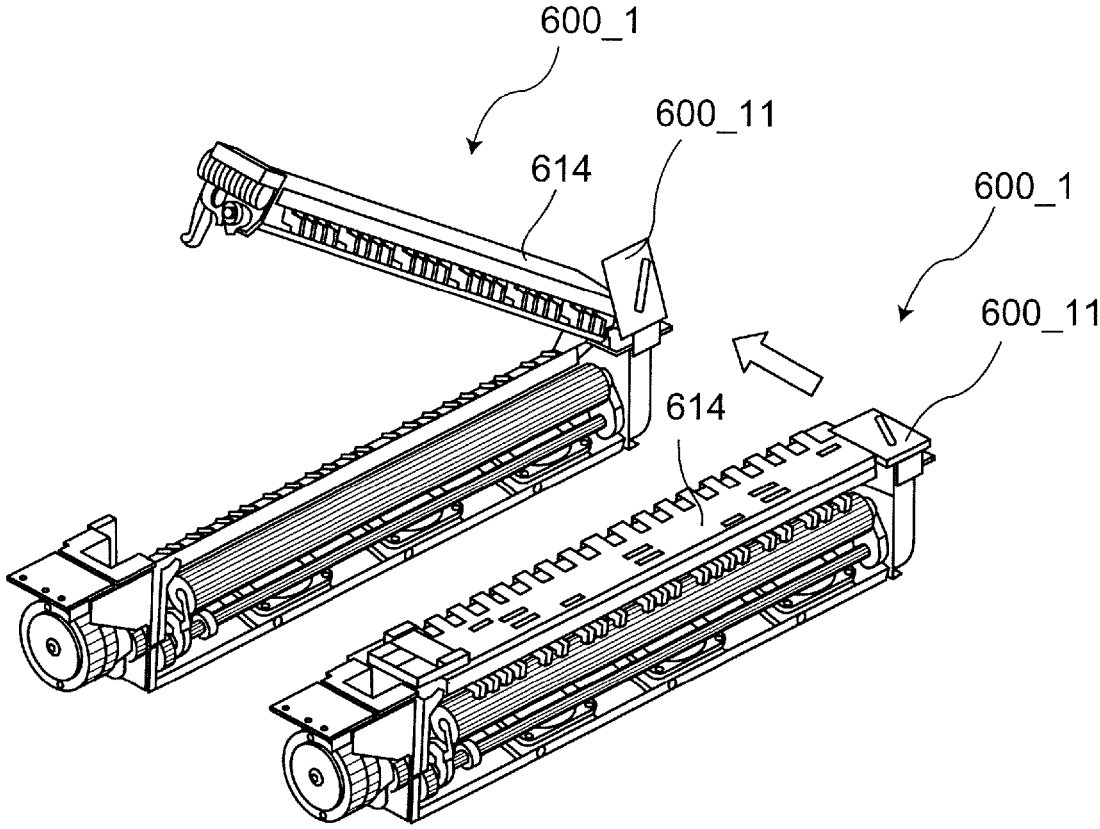
FIG. 11 is a perspective drawing of the curl correction device equipped with a finger-nip prevention member.
Figure 12:
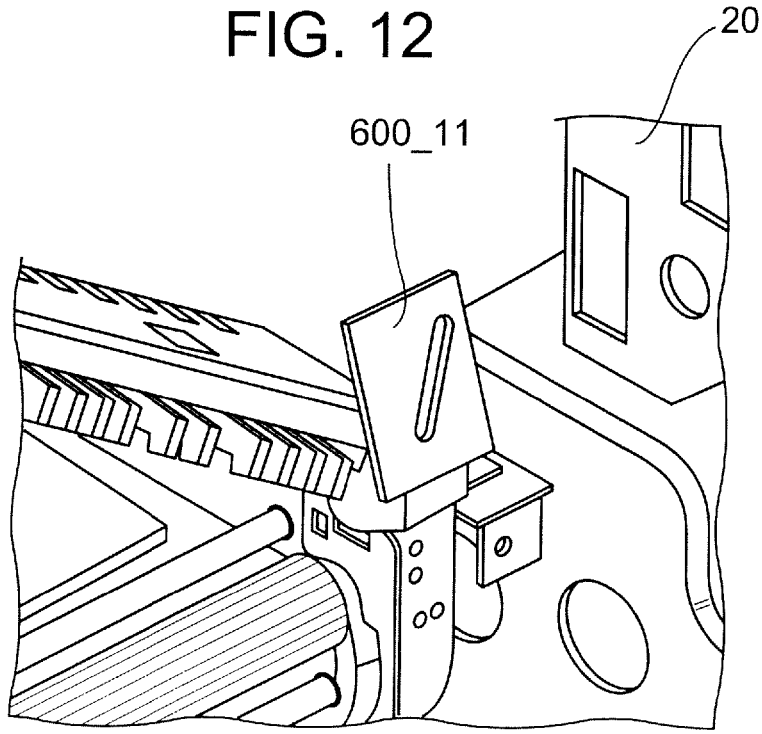
FIG. 12 is a drawing showing a state in which the finger-nip prevention member is abutting the housing.

FIG. 11 is a perspective drawing of the curl correction device equipped with a finger-nip prevention member. FIG. 12 is a drawing showing a state in which the finger-nip prevention member is abutting the housing.

The curl correction device 600_1 shown in FIG. 11 has a finger-nip prevention member 600_11. When the upper assembly part 614 is in a closed state, the finger-nip prevention member 600_11 is pressed in a manner to overlap the upper surface of the upper assembly part 614. If the upper assembly part 614 is lifted, the side face of the upper assembly part 614 contacts the finger-nip prevention member 600_11, thereby raising the finger-nip prevention. Thus, when the lifted upper assembly part is to be accommodated in the housing 20, the raised finger-nip prevention member abuts the housing 20 as shown in FIG. 12, preventing a case where the end close to housing 20 of the upper assembly part 614 contacts the housing 20 and the upper assembly part 614 falls.

Figure 13:
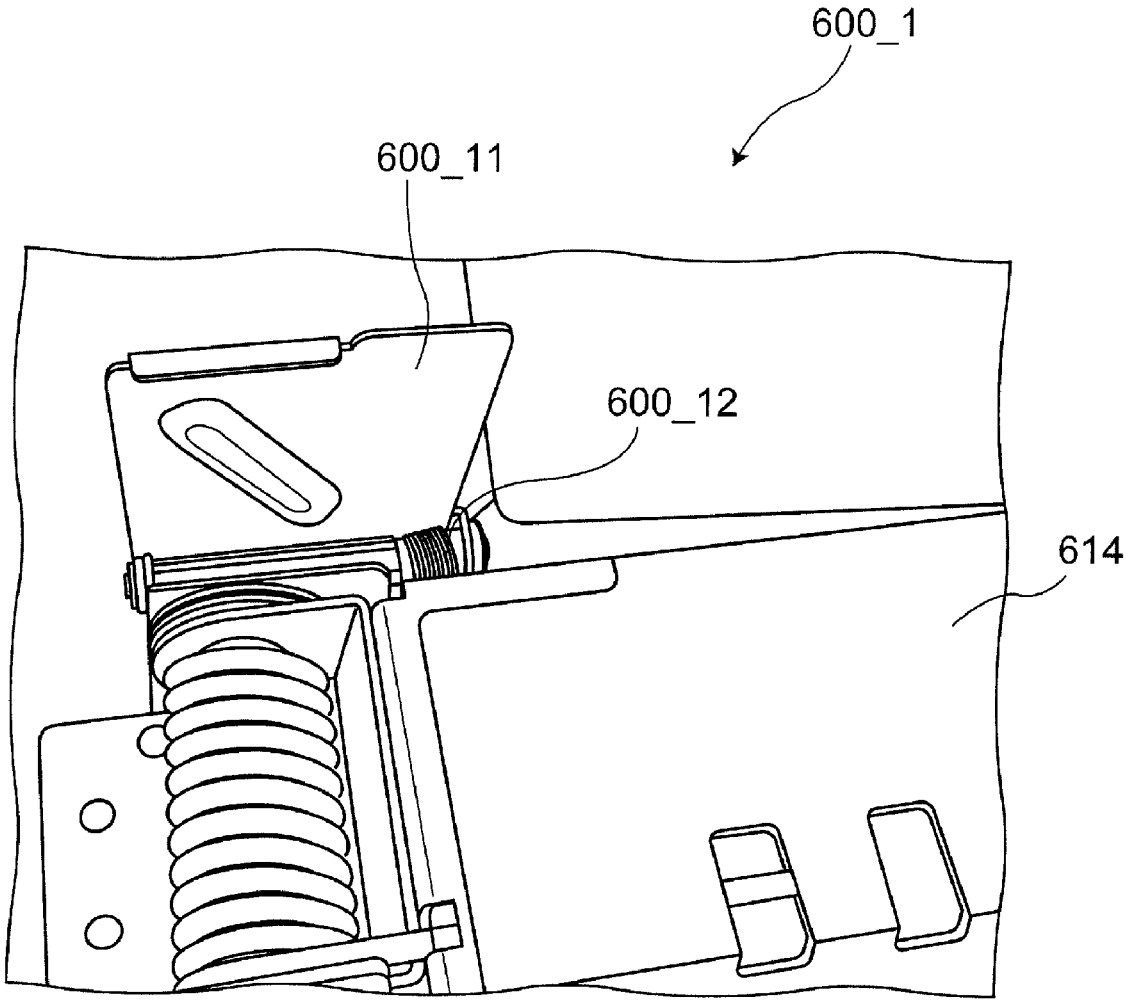
FIG. 13 is a drawing in which the finger-nip prevention member is lifted from the upper assembly part.
Figure 14:
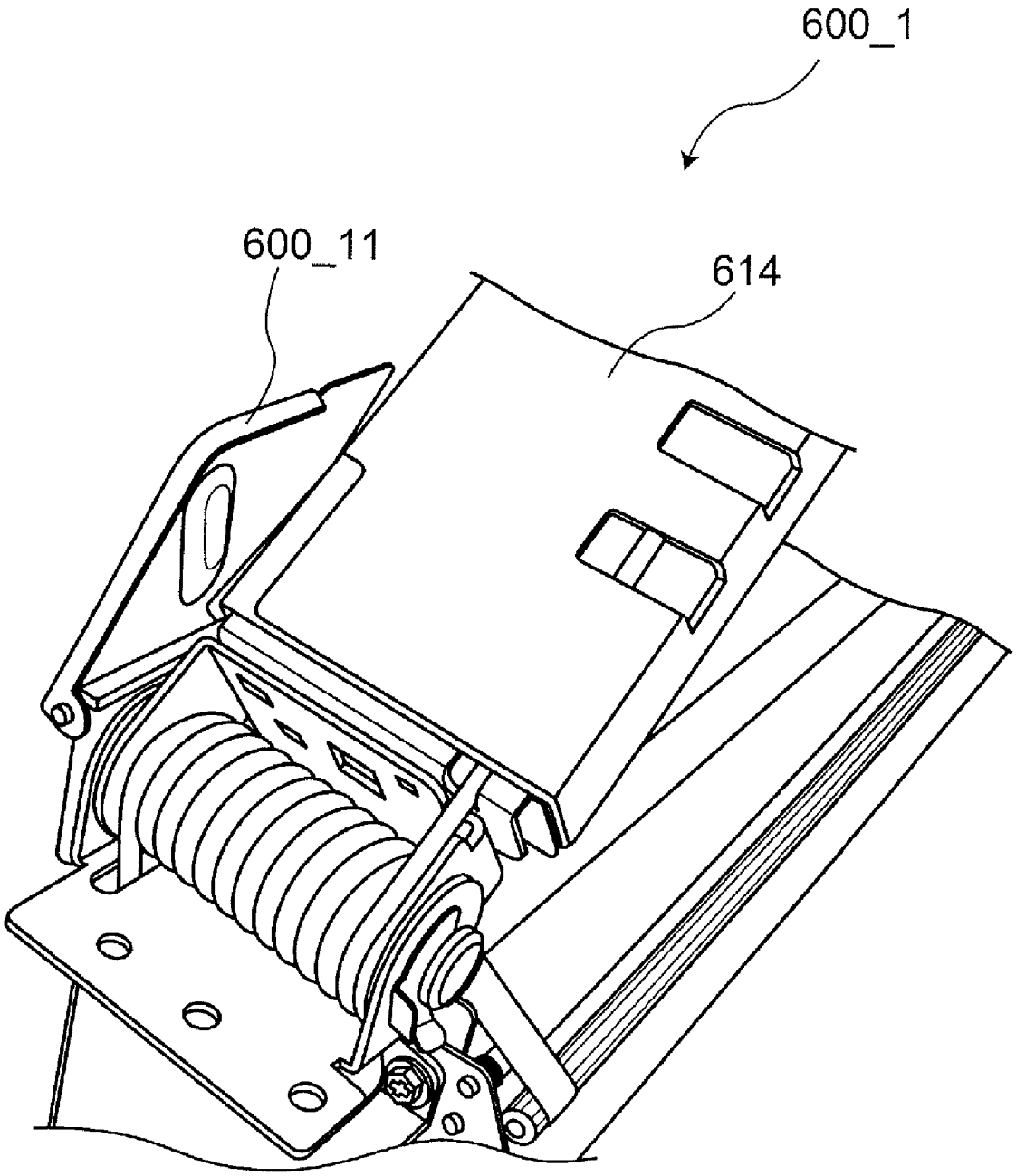
FIG. 14 is an enlarged view of the finger-nip prevention member and the upper assembly part.

FIG. 13 is a drawing in which the finger-nip prevention member is lifted from the upper assembly part. FIG. 14 is an enlarged view of the finger-nip prevention member and the upper assembly part.

As shown in FIG. 13, the finger-nip member 600_11 is pressed by a spring member 600_12. Thus, when the upper assembly part 614 is in the closed state, the finger-nip member 600_11 overlaps the upper surface of the upper assembly part 614. If the upper assembly part 614 is lifted, the side face of the upper assembly part 614 contacts and raises the finger-nip prevention member 600_11.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling other skilled in the art to understand the invention for various embodiments and with the various modifications as are suited to the particular use contemplated. It is intended that the scope of the invention be defined by the following claims and their equivalents.

What is claimed is:

1. A curl correction device that corrects curl, comprising:

a curl correction shaft that drives to carry a sheet;

a first supporting member that supports the curl correction shaft;

a curl correction roll that operates in closed state where the curl correction roll is disposed in parallel with the curl correction shaft, holds the sheet between the curl correction shaft and the curl correction roll and presses the sheet against the curl correction shaft;

a second supporting member that supports the curl correction roll, and rotates the curl correction roll around the vicinity of a first end in the longitudinal direction of the curl correction roll between the closed state and open state in which a second end in the longitudinal direction of the curl correction roll is placed away from the curl correction shaft; and a cam mechanism that provides, via a cam, the curl correction roll with driving force for pressing the curl correction shaft according to a position of the cam, wherein the cam mechanism comprises:

a cam shaft that is supported by the first supporting member, that is extended in parallel with the curl correction shaft, that is rotated in response to driving force when the curl correction roll is in the closed state, around a rotation axis along a direction in which the cam shaft is extended, and that has a first rotation cam and a second rotation cam fixed thereto at positions respectively corresponding to the first end and the second end of the curl correction roll in the closed state, the cam shaft remaining together with the curl correction shaft without being rotated together with the curl correction roll while the curl correction roll is rotated between the closed state and the open state;

a connecting member that is pivotally supported by the first supporting member at a position corresponding to the first end of the curl correction roll in the closed state, and that receives, from the first rotation cam, driving force corresponding to rotation angle of the cam shaft around the rotation axis when the curl correction roll is in the closed state, the connecting member remaining together with the curl correction shaft without being rotated together with the curl correction roll while the curl correction roll is rotated between the closed state and the open state;

a first cam receiving member that is fixed to the first end of the curl correction roll, and that receives, from the first rotation cam, driving force according to rotation angle of the cam shaft around the rotation axis via the connecting member when the curl correction roll is in the closed state, the first cam receiving member being rotated together with the curl correction roll while the curl correction roll is rotated between the closed state and the open state; and a second cam receiving member that is fixed to the second end of the curl correction roll, extending toward the second rotation cam, and receives~from the second rotation cam driving force according to rotation angle of the cam shaft around the rotation axis when the curl correction roll is in the closed state, the second cam receiving member being rotated together with the curl correction roll while the curl correction roll is rotated between the closed state and the open state.

2. The curl correction device according to claim 1, further comprising:

a second curl correction shaft that contacts a second face of a sheet, the second face being the back of a first face of the sheet in contact with the curl correction shaft, drives to carry the sheet and is supported by the second supporting member;

a second curl correction roll that operates in closed state in which the second curl correction roll is disposed in parallel with the second curl correction shaft, holds the sheet between the second curl correction shaft and the second curl correction roll, presses the sheet against the second curl correction shaft, and is supported by the first supporting member; and a second cam mechanism that provides, via a cam, the second curl correction roll with driving force for pressing the second curl correction shaft according to a position of the cam, and that is disposed at the side of the first supporting member.

3. A curl correction device that corrects curl according to claim 1, further comprising a finger-nip prevention member that is oriented in a substantially horizontal plane and is disposed over the first end in the longitudinal direction of the curl correction roll when the second supporting member is in the closed state, and is oriented in a substantially vertical plane when the second supporting member is in the open state.

4. The curl correction device according to claim 1, further comprising a sheet carrying path on which a sheet is carried, wherein the first cam receiving member avoids intersecting with the sheet carrying path when the curl correction roll is in the open state.

5. An image forming apparatus comprising:

a sheet carrying unit that carries a sheet;

an image forming unit that forms an image according to an image signal;

a sheet heating unit that heats a sheet having an image formed by the image forming unit;

a curl correction unit that corrects curl of the sheet after the sheet is heated by the sheet heating unit; and a housing that houses the sheet carrying unit, the image forming unit, the sheet heating unit, and the curl correction unit, wherein the curl correction unit has a curl correction assembly that is an integral unit, and the housing has a guiding member to pull out the curl correction assembly from the housing in a manner that the curl correction assembly can be housed, wherein the curl correction assembly comprises:

a curl correction shaft that drives to carry a sheet;

a first supporting member that supports the curl correction shaft;

a curl correction roll that operates in closed state where the curl correction roll is disposed in parallel with the curl correction shaft, holds the sheet between the curl correction shaft and the curl correction roll and presses the sheet against the curl correction shaft;

a second supporting member that supports the curl correction roll, and rotates the curl correction roll around the vicinity of a first end in the longitudinal direction of the curl correction roll between the closed state and open state in which a second end in the longitudinal direction of the curl correction roll is placed away from the curl correction shaft, and a cam mechanism that provides, via a cam, the curl correction roll with driving force for pressing the curl correction shaft according to a position of the cam, wherein the cam mechanism comprises:

a cam shaft that is supported by the first supporting member, that is extended in parallel with the curl correction shaft, and that is rotated in response to driving force when the curl correction roll is in the closed state, around a rotation axis along a direction in which the cam shaft is extended, and hat has a first rotation cam and a second rotation cam fixed thereto at positions respectively corresponding to the first end and the second end of the curl correction roll in the closed state, the cam shaft remaining together with the curl correction shaft without being rotated together with the curl correction roll while the curl correction roll is rotated between the closed state and the open state;

a connecting member that is pivotally supported by the first supporting member at a position corresponding a the first end of the curl correction roll in the closed state, and that receives, from the first rotation cam, driving force corresponding to rotation angle of the cam shaft around the rotation axis when the curl correction roll is in the closed state, the connecting member remaining together with the curl correction shaft without being rotated together with the curl correction roll while the curl correction roll is rotated between the closed state and the open state;

a first cam receiving member that is fixed to the first end of the curl correction roll, and that receives, from the first rotation cam, driving force according to rotation angle of the cam shaft around the rotation axis via the connecting member when the curl correction roll is in the closed state, the first cam receiving member being rotated together with the curl correction roll while the curl correction roll is rotated between the closed state and the open state; and a second cam receiving member that is fixed to the second end of the curl correction roll, extending toward the second rotation cam, and receives~from the second rotation cam~driving force according to rotation angle of the cam shaft around the rotation axis when the curl correction roll is in the closed state, the second cam receiving member being rotated together with the curl correction roll while the curl correction roll is rotated between the closed state and the open state, wherein the curl correction assembly is housed in the housing in the direction in which the curl correction assembly is pulled out from the housing with the second end at a top.

6. The image forming apparatus according to claim 5, wherein the curl correction assembly further comprises:

a second curl correction shaft that contacts a second face of a sheet, the second face being the back of a first face of the sheet in contact with the curl correction shaft, drives to carry the sheet, and is supported by the second supporting member;

a second curl correction roll that operates in closed state in which the second curl correction roll is disposed in parallel with the second curl correction shaft, holds the sheet between the second curl correction shaft and the second curl correction roll and presses the sheet against the second curl correction shaft, and is supported by the first supporting member; and a second cam mechanism that provides, via a cam, the second curl correction roll with driving force for pressing the second curl correction shaft according to a position of the cam, and that is disposed at the side of the first supporting member.

7. An image forming apparatus according to claim 5, further comprising a finger-nip prevention member that is oriented in a substantially horizontal plane and is disposed over the first end in the longitudinal direction of the curl correction roll when the second supporting member is in the closed state, and is oriented in a substantially vertical plane when the second supporting member is in the open state.

8. An image forming apparatus according to claim 5, further comprising a sheet carrying path on which a sheet is carried, wherein the first cam receiving member avoids intersecting with the sheet carrying path when the curl correction roll is in the open state.

* * * * *